US010526861B2

(12) United States Patent
Rogozinski et al.

(10) Patent No.: US 10,526,861 B2
(45) Date of Patent: Jan. 7, 2020

(54) CENTRALIZED CONTROL OF WELLBORE CEMENT HEAD AND PUMPING UNIT

(71) Applicant: Halliburton Energy Services, Inc., Houston, TX (US)

(72) Inventors: Nicolas Rogozinski, Spring, TX (US); Henry E. Rogers, Oklahoma City, OK (US); Jithendra Rao Naidu, Bull Creek (AU)

(73) Assignee: Halliburton Energy Services, Inc., Houston, TX (US)

( * ) Notice: Subject to any disclaimer, the term of this patent is extended or adjusted under 35 U.S.C. 154(b) by 53 days.

(21) Appl. No.: 15/758,100

(22) PCT Filed: Oct. 28, 2015

(86) PCT No.: PCT/US2015/057864
§ 371 (c)(1),
(2) Date: Mar. 7, 2018

(87) PCT Pub. No.: WO2017/074363
PCT Pub. Date: May 4, 2017

(65) Prior Publication Data
US 2018/0245418 A1 Aug. 30, 2018

(51) Int. Cl.
*E21B 33/05* (2006.01)
*E21B 33/13* (2006.01)
(Continued)

(52) U.S. Cl.
CPC ..... *E21B 33/05* (2013.01); *E21B 33/13* (2013.01); *E21B 33/14* (2013.01); *E21B 34/02* (2013.01);
(Continued)

(58) Field of Classification Search
CPC ..... E21B 33/05; E21B 33/13; E21B 33/14; E21B 47/06; E21B 47/065; E21B 47/00; E21B 34/02
See application file for complete search history.

(56) References Cited

U.S. PATENT DOCUMENTS 3,376,921 A * 4/1968 Manry ..... E21B 19/08 166/250.14
3,971,346 A * 7/1976 McReynolds ..... F01C 1/3442 123/236

(Continued)

FOREIGN PATENT DOCUMENTS

WO WO 2014/169166 A2 10/2014

OTHER PUBLICATIONS

International Search Report and the Written Opinion of the International Search Authority, or the Declaration, dated Jul. 25, 2016, PCT/US2015/057864, 12 pages, ISA/KR.

*Primary Examiner* — Yong-Suk Ro
(74) *Attorney, Agent, or Firm* — Haynes and Boone, LLP

(57) ABSTRACT

Centralized control of a cement head using a pumping unit control device is provided. The control device, located at the pumping unit, is communicably coupled to the cement head and pumping unit via a wired or wireless link. Using the control device, the pumping unit operator sends control signals to the pumping unit and cement head to control the cementing operation from outside the red zone, thereby removing the need for a rig hand to operate the cement head.

16 Claims, 3 Drawing Sheets

(51) Int. Cl.

| | |
|---|---|
| ***E21B 33/14*** | (2006.01) |
| ***E21B 34/02*** | (2006.01) |
| ***E21B 47/00*** | (2012.01) |
| *E21B 47/06* | (2012.01) |

(52) U.S. Cl.
CPC ..... *E21B 47/00* (2013.01); *E21B 47/06* (2013.01); *E21B 47/065* (2013.01)

(56) References Cited

U.S. PATENT DOCUMENTS

| | | | | |
|---|---|---|---|---|
| 5,735,348 | A * | 4/1998 | Hawkins, III | E21B 21/01 166/285 |
| 2003/0132002 | A1* | 7/2003 | Giebeler | E21B 21/02 166/365 |
| 2007/0295509 | A1 | 12/2007 | Pessin et al. | |
| 2011/0168380 | A1 | 7/2011 | Osmundsen et al. | |
| 2013/0138254 | A1 | 5/2013 | Seals et al. | |
| 2013/0327532 | A1 | 12/2013 | Ring et al. | |
| 2014/0034310 | A1* | 2/2014 | Andersen | E21B 34/14 166/281 |
| 2015/0267504 | A1 | 9/2015 | Hannegan | |

* cited by examiner

CENTRALIZED CONTROL OF WELLBORE CEMENT HEAD AND PUMPING UNIT

PRIORITY

The present application is a U.S. National Stage patent application of International Patent Application No. PCT/US2015/057864, filed on Oct. 28, 2015, the benefit of which is claimed and the disclosure of which is incorporated herein by reference in its entirety.

FIELD OF THE DISCLOSURE

The present disclosure relates generally to wellbore servicing tools used in the oil and gas industry and, more specifically, to remote centralized control of a cement head and cement pumping unit.

BACKGROUND

During completion of oil and gas wells, cement is often used to solidify a well casing within the newly drilled wellbore. To accomplish this, cement slurry is first pumped through the inner bore of the well casing and either out its distal end or through one or more ports defined in the well casing at predetermined locations. Cement slurry exits the well casing into the annulus formed between the well casing and the wellbore and is pumped back up toward the surface within the annulus. Once the cement hardens, it forms a seal between the well casing and the wellbore to protect oil producing zones and non-oil producing zones from contamination. In addition, the cement bonds the casing to the surrounding rock formation, thereby providing support and strength to the casing and also preventing blowouts and protecting the casing from corrosion.

Prior to cementing, the wellbore and the well casing are typically filled with drilling fluid or mud. A cementing plug is then pumped ahead of the cement slurry in order to prevent mixing of the drilling mud already disposed within the wellbore with the cement slurry. When the cementing plug reaches a collar or shoulder stop arranged within the casing at a predetermined location, the hydraulic pressure of the cement slurry ruptures the plug and enables the cement slurry to pass through the plug and then through either the distal end of the casing or the side ports and into the annulus. Subsequently, another cementing plug is pumped down the casing to prevent mixing of the cement slurry with additional drilling mud that will be pumped into the casing following the cement slurry. When the top cementing plug lands on the collar or stop shoulder, the pumping of the cement slurry ceases.

To perform the aforementioned cementing operations, a cement head and pumping unit are usually employed. The cement head is arranged at the surface of the wellbore in what is referred to as the "red" or high danger zone. The cementing plugs are held within the cement head until the cementing operation requires their deployment. Various valves associated with the cement head are required to be manipulated in order to perform the required tasks of the cement head. Such valves are typically manipulated manually, thereby requiring rig personnel to be in close proximity to the cement head (i.e., the red zone) and other wellbore equipment. In some cases, rig hands are required to be strapped and suspended in the air in order to operate the valves as the cement is pumped by the cement pumping unit. As can be appreciated, this presents a potential safety hazard.

Moreover, the cement pumping unit used to pump the cement is located remotely from the cement head, i.e., outside the red zone. In land wells, the pumping unit is typically about 150 yards away from the cement head, while in floating rigs the pumping unit is usually many floors away from the cement head. Thus, during cementing operations, the operator at the pumping unit control device must communicate with the rig hand at the cement head to instruct him when/how to operate the valves. Due to noise and other issues inherent in communication, the cement operation time is increased. Quite often, the operation must be suspended in order to allow communication between the pumping unit operator and cement head rig hand, further increasing the time and cost associated with cementing operations.

DESCRIPTION OF ILLUSTRATIVE EMBODIMENTS

Illustrative embodiments and related methodologies of the present disclosure are described below as they might be employed in a system and method for centralized control and operation of a cement head and pumping unit. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As described herein, illustrative embodiments and methods of the present disclosure provide centralized control of a cement head using a pumping unit control device. The control device, located at the cement pumping unit, is communicably coupled to the cement head and pumping unit via a wired or wireless link. Using the control device, the pumping unit operator sends control signals to the pumping unit and cement head to control the cementing operation from outside the red zone, thereby removing the need for a rig hand to operate the cement head. Moreover, sensors onboard the cement head and pumping unit may communicate status indicators (e.g., operational parameters) to the control device, whereby the pumping unit operator remains aware of the condition of the circulation system in real-time, and may manipulate the cement head/pumping unit as needed. Accordingly, by centralizing control of the cement head and pumping unit, quality assurance is maximized, there is increased operational timing for cementing, and rig time is reduced since there is less human interaction overseeing operation of the wellhead.

Figure 1A:
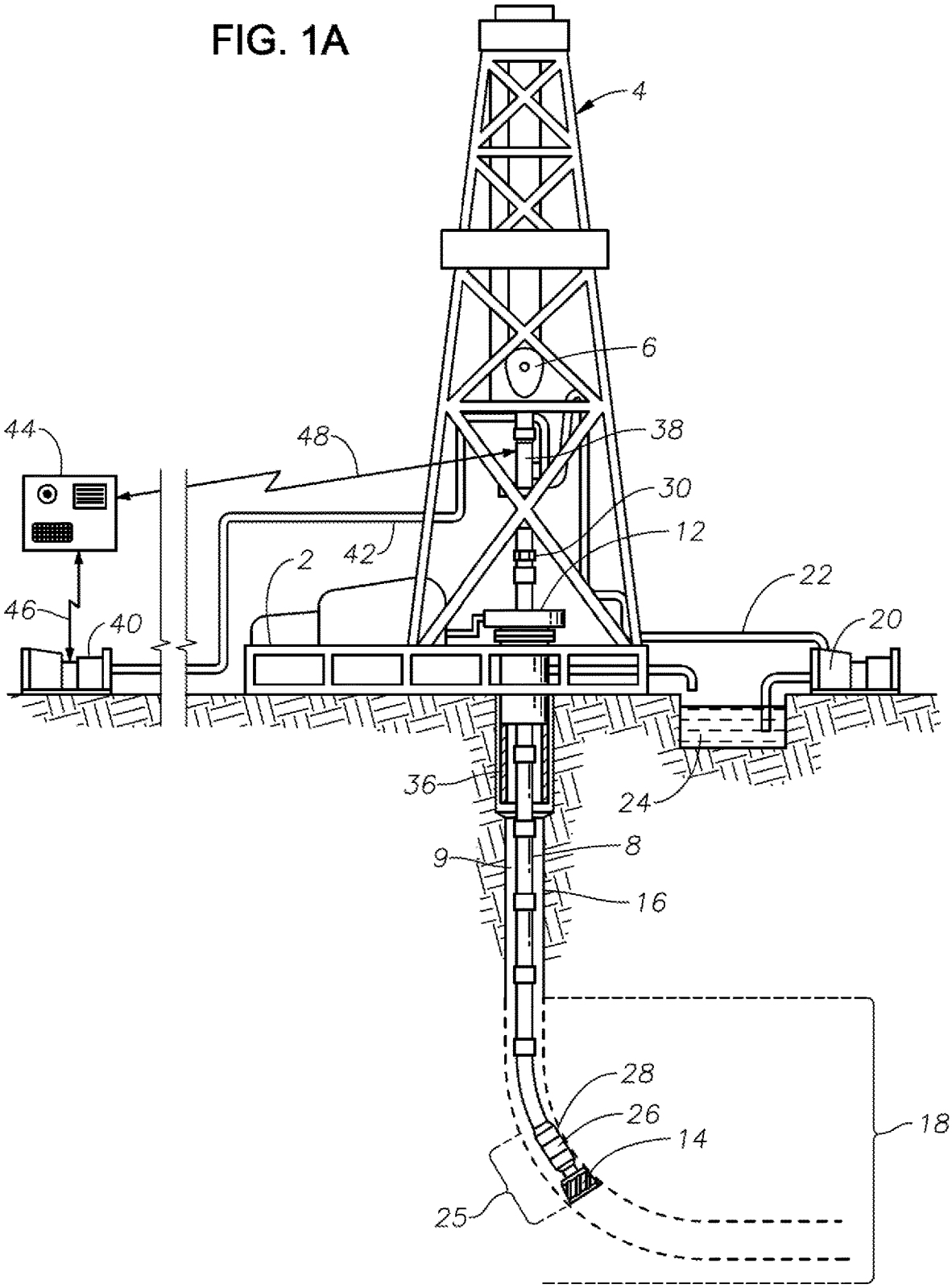
FIG. 1A illustrates a drilling application in which the illustrative embodiments of the present disclosure may be practiced.

FIG. 1A shows a drilling environment in which the illustrative embodiments of the present disclosure may be practiced. In FIG. 1A, a drilling rig platform 2 supports a derrick 4 having a traveling block 6 for raising and lowering a drill string 8. A drill string kelly (not shown) supports the rest of drill string 8 as it is lowered through a rotary table 12. Rotary table 12 rotates drill string 8, thereby turning drill bit 14. As drill bit 14 rotates, it creates a borehole 16 that passes through various formations 18. A mud pump 20 circulates drilling fluid through a feed pipe 22 to kelly 10, downhole through the interior of drill string 8, through orifices in drill bit 14, back to the surface via annulus 9 around drill string 8, and into a retention pit 24. The drilling fluid transports cuttings from borehole 16 into retention pit 24 and aids in maintaining the integrity of borehole 16. An upper portion of the borehole 16 is cased and the lower portion is open (uncased) borehole.

Drill bit 14 is just one piece of an open-hole logging-while-drilling ("LWD") assembly that includes a bottom-hole assembly 25 having one or more drill collars 26 and logging tool 28. Drill collars 26 are thick-walled steel pipe sections that provide weight and rigidity for the drilling process. Logging tool 28, which may be integrated into one of the drill collars, gathers measurements of various drilling or formation parameters. Illustrative drilling parameters include weight on bit, torque, and rate of penetration.

Measurements from logging tool 28 can be acquired by a telemetry sub (e.g., integrated with logging tool 28) to be stored in internal memory and/or communicated to the surface via a communications link. Mud pulse telemetry is one technique for providing a communications link for transferring logging measurements to a surface receiver 30 and for receiving commands from the surface, but other telemetry techniques can also be used. In accordance with at least some embodiments, measurements collected from logging tool 28 are processed by a computer to produce one or more well logs for analysis.

Figure 1B:
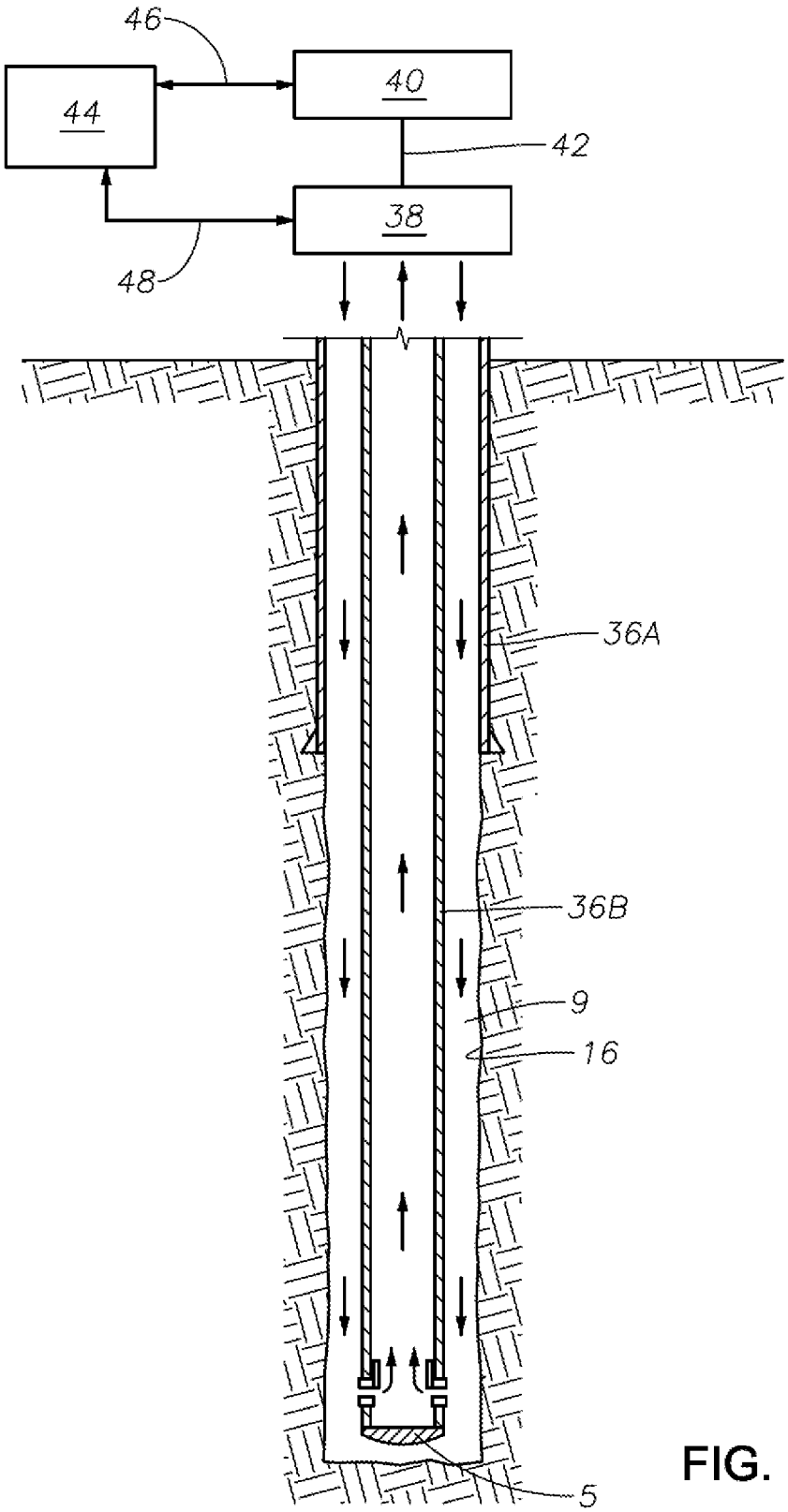
FIG. 1B illustrates a cementing operation according to certain illustrative methods of the present disclosure.

Still referring to FIG. 1A, a portion of wellbore 16 is cased with a casing 36. To perform the cementing required during the casing operation, a cement head 38 is positioned in-line with the work string associated with wellbore 16. FIG. 1B is a block diagram of a system for cementing wellbore 16, and useful to illustrate an illustrative cementing operation of the present disclosure. With reference to FIGS. 1A and 1B, cement head 38 is used to deliver cement or other wellbore servicing fluids and/or mixtures (e.g., spacers or water) to wellbore 16 through the drill string or other downhole tubulars to which cement head 38 is attached. The cement is supplied from cement pumping unit 40 through feed pipe 42. Cement head 38 is also capable of delivering darts and/or balls for activating or initiating some function of a tool or structure associated with the work string.

A control device 44 is communicably coupled to pumping unit 40 via a link 46. Link 46 may be a wired or wireless communications link. In addition, control device 44 may form part of pumping unit 40 or may be a standalone unit. Control device 44 is also communicably coupled to cement head 38 via link 48, which may also be a wired or wireless communications link. As such, control device 44, cement head 38 and pumping unit 40 each include the necessary communication units for wired or wireless communication. According to the illustrative embodiments described herein, control device 44 provides centralized control of pumping unit 40 and cement head 38, thereby removing the need for a rig hand to manipulate the various mechanical devices of cement head 38 in the red zone. The mechanical devices may include, for example, valves, levers, plungers or pumps onboard pumping unit 40.

With reference to FIG. 1B, a cross-sectional side view of a well is shown. Surface casing 36A is set at the surface of the well and a well head (not shown) is connected to the surface casing 36A. Casing 36B is suspended from the well head. Casing 36B has a shoe 5 at its lowermost end. Annulus 9 is defined between casing 36B and well bore 16. Retention pit 24 is positioned to receive fluid from the ID of the casing 36B via a return pipe. Cement head 38 is in fluid communication with annulus 9 and the ID of casing 36B.

As previously described, pumping unit 40 is in fluid communication with cemtn head 38 via feed pipe 42. The inlet side of pumping unit 40 is connected to a cement source whereby a cement composition may be mixed and provided to unit 40. In this illustrative method, pumping unit 40 then pumps the cement composition into annulus 9 through cement head 38 and the well head. Pumping unit 40 is used to pump a sufficient amount of cement composition into the annulus 9 until the weight of the cement composition in annulus 9 is sufficient to maintain fluid flow in the reverse-circulation direction through annulus 9 and the inner diameter of casing 36B. Returns from the inner diameter of casing 36B are taken through the return pipe and deposited in pit 24. A remainder of cement composition is allowed to flow into annulus 9 until the entire annulus is full. When the cement composition reaches casing shoe 5, the flow of cement composition is stopped and the cement composition is allowed to harden or set in annulus 5 as understood in the art. As described in more detail throughout this disclosure, control device 44 is communicably coupled to pumping unit 40 and cement head 38 via links 46 and 48. Using control device 44, the pumping unit operator sends control signals to pumping unit 40 and cement head 38 to control the cementing operation from outside the red zone, thereby removing the need for a rig hand to operate the cement head.

Although not explicitly shown in FIGS. 1A and 1B, it will be recognized that control device 44 may be connected to one or more public and/or private networks via one or more appropriate network connections. Moreover, those ordinarily skilled in the art will appreciate that the control device 44 may be implemented using a variety of computer-system configurations, including hand-held devices, multiprocessor systems, microprocessor-based or programmable-consumer electronics, minicomputers, mainframe computers, and the like. Any number of computer-systems and computer networks are acceptable for use with the present invention. The invention may be practiced in distributed-computing environments where tasks are performed by remote-processing devices that are linked through a communications network. In a distributed-computing environment, program modules may be located in both local and remote computer-storage media of control device 44, including any known memory storage devices. The present invention may therefore, be implemented in connection with various hardware, software or a combination thereof in a computer system or other processing system.

The processing system of control device 44 may further include a processor for executing instructions and a non-transitory machine-readable medium, such as a volatile or non-volatile memory, for storing data and/or instructions for software programs. The instructions may be executed by the processing system to control and manage access to the various networks, as well as provide other communication and processing functions. The instructions may also include instructions executed by the processing system for various components of control device 44, such as the display, an input interfaces, etc.

Still referring to FIGS. 1A and 1B, control device 44 may be operable by a user, such as a well operator. One or more inputs are provided in control device 44 for operation by the user, with each of the inputs having an associated function. For example, one of the inputs may be associated with a specific operation of a mechanical device onboard pumping unit 40 or cement head 38 such as, for example, open, partially open, close, partially close, activate, deactivate, etc. Control device 44 may further include one or more displays for providing information to the user. The display may be associated with the current state of control device 44, one of the inputs, and/or the mechanical devices onboard cement head 38 or pumping unit 40.

With regard to the operation of mechanical devices, illustrative embodiments of pumping unit 40 and cement head 38 may include onboard reception and processing devices to open, partially open, close, partially close, activate, and/or deactivate a corresponding valve. Such actions may be achieved by rotating or moving the valve. For example, pumping unit 40 may include a pneumatic actuator that operates a cell, canister, or tank of a compressible fluid for operation of a valve. The compressible fluid may include nitrogen, oxygen, air, or any compressible gas. At least a portion of the pneumatic actuator may connect to a chamber of cement head 38. In other embodiments, pumping unit 40 may include any other type of actuating device capable of manipulating a corresponding valve including, but not limited to, mechanical actuators, electromechanical actuators, hydraulic actuators, piston and solenoid assemblies, combinations thereof, and the like. By further example, such actions may be applied to other mechanical devices of cement head 38, such as levers and/or plungers in like manner.

In one illustrative operation, control device 44 transmits a first command signal to cement head 38 via link 48, in order to affect some control or operation of mechanical devices onboard cement head 38. Control device 44 is also configured to transmit a second command signal to cement pumping unit 40 via link 46, in order to affect some control or operation of pumping unit 40. In addition to affecting control over the remote units, control device 44 may also receive status indicators from cement head 38 and pumping unit 40, as will be discussed in more detail below. The first and second command signals may be transmitted either wired or wirelessly. In embodiments where the signals are transmitted wirelessly, control device 44 may include a wireless transmitter, as would be understood by those ordinarily skilled in the art having the benefit of this disclosure.

The first and/or second command signals may encompass, for example, a user command. In certain illustrative embodiments, the user command may include instructions for the mechanical devices onboard cement head 38 and pumping unit 40, as previously discussed. Therefore, in such embodiments, the onboard mechanical devices are configured to receive the command signals from control device 44 using some form of wired/wireless receiver. As such, pumping unit 40 and cement head 38 are operated in response to the command signals transmitted from control device 44, thus providing a centralized control platform.

Moreover, as previously mentioned, in certain illustrative embodiments pumping unit 40 or cement head 38 may transmit status indicators to control device 44. The data represented in the status indicators/parameters may be accessible to the user via control device 44 during or after a procedure involving cement head 38. The collected status indicator data may be correlated and compared as desired. For example, a user may analyze timing of commands and actuation of valves, levers, and/or plungers. The time span between the transmission of a user command from control device 44 and the completion of an associated operation by pumping unit 40 or cement head 38 may be determined and analyzed. For instance, a user may compare the period of time from when a wellbore projectile (i.e., dart, ball, plug, etc.) is released from cement head 38 to a pressure spike once the wellbore projectile lands on a downhole tool, shoulder, or obstruction.

Commands and operations may also be compared with sensed parameters, such as pressure or temperature at or near one or more valves, levers, and/or plungers. In such embodiments, parameters are sensed using any variety of sensors positioned in pumping unit 40 or cement head 38. The analysis may identify proper or improper operation, as well as any needed optimizations to improve performance of the cement head 38 and pumping unit 40. In response to the received status indicators, control device 44 may send further command signals to pumping unit 40/cement head 38 to achieve such operational optimizations.

In addition, the sensors may be sensitive to a state of the mechanical devices (e.g., open, partially open, closed, partially closed, present, absent, and the like). For example, the sensors may detect a time at which a mechanical device changes from one state (e.g., open) to another state (e.g., closed). The sensors may detect the presence, absence, or motion of a plunger and an associated time. For example, one or more sensors may detect a time at which a plunger is released and a time that the plunger arrives at a given location after release. The sensors may further be sensitive to conditions within cement head 38 (e.g., pressure, flow rate, temperature, proximity sensors, and the like). As will be appreciated, multiple sensors may be provided in or otherwise associated with pumping unit 40 and cement head 38, each having a distinct sensitivity and function.

Figure 2:
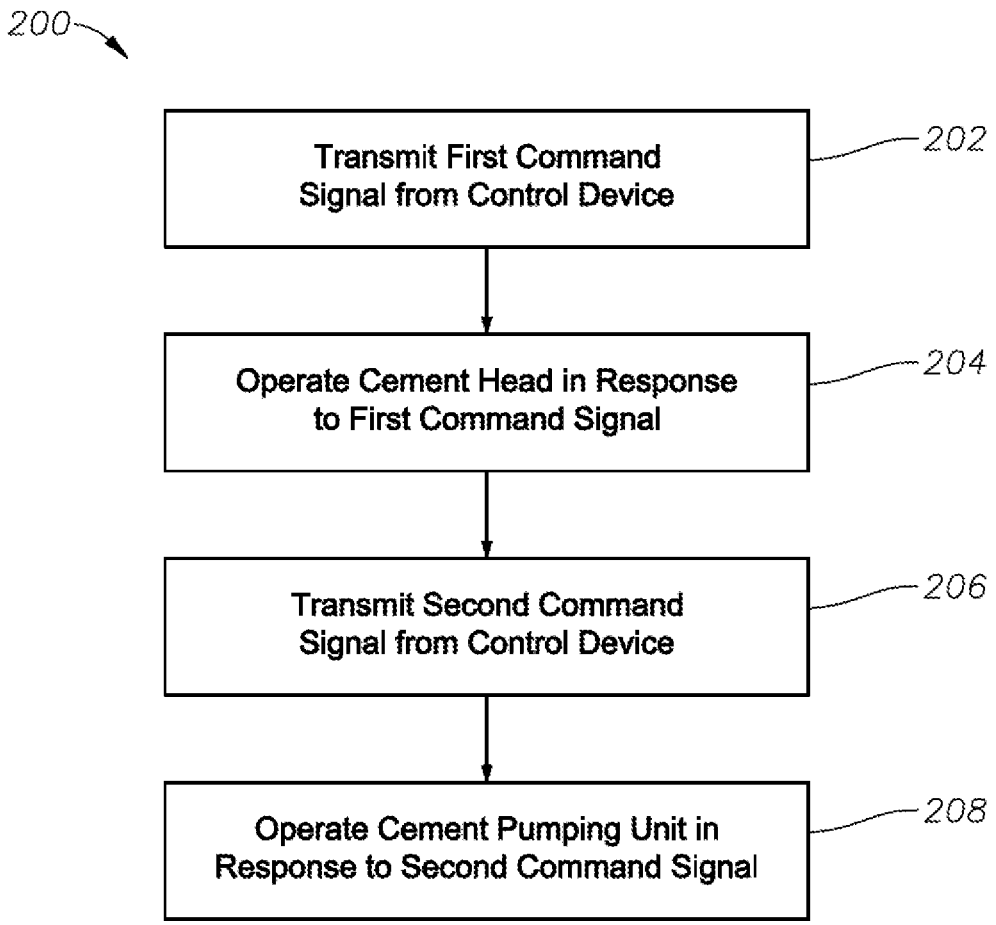
FIG. 2 is a flow chart of an illustrative method 200 for centralized control of a cement head and cement pumping unit, as described herein.

FIG. 2 is a flow chart of an illustrative method 200 for centralized control as described herein. At block 202, a user initiates transmission of a first command signal from the control device. The first command signal is received by the cement head at block 204 and it is operated accordingly. At block 206, a second command signal is transmitted from the control device, whereby it is received by the cement pumping unit at block 28. Once received, the corresponding operation of the pumping unit is conducted. Also, during the bi-directional communication, status indicator signals may be transmitted from the cement head or pumping unit to the control device, whereby the user can review, analyze, etc., the data, and then transmit further command signals in response.

Accordingly, the illustrative embodiments and methods described herein provide centralized control and operation of a cement head and cement pumping unit. Along with the advantages of controlling a cement head from a remote location outside the red zone, having one control device for both the pumping unit and cement head provides a number of advantages. These advantages include, for example, the increased efficiency in operating the cement head from a timing perspective; the ability to record all activations, timings, etc. using a centralized system; and the decrease in human interaction since there is no need for rig hand at the cement head. Therefore, safety is maximized while costly rig time is minimized.

Methods and embodiments described herein further relate to any one or more of the following paragraphs:

1. A method for centralized control of a cement head and pumping unit, the method comprising: transmitting a first command signal from a control device; operating a mechanical device of a cement head in response to the first command signal; transmitting a second command signal from the control device; and operating a mechanical device of a pumping unit in response to the second command signal.

2. A method as defined in paragraph 1, wherein the control device forms part of the pumping unit.

3. A method as defined in paragraphs 1 or 2, further comprising receiving a status indicator of the cement head at the control device; transmitting a third command signal from the control device in response to the status indicator; and operating the mechanical device of the cement head in response to the third command signal.

4. A method as defined in any of paragraphs 1-3, further comprising: receiving a status indicator of the pumping unit at the control device; transmitting a fourth command signal from the control device in response to the status indicator; and operating the mechanical device of the pumping unit in response to the fourth command signal.

5. A method as defined in any of paragraphs 1-4, further comprising wirelessly transmitting the first and second command signals.

6. A system for centralized control of a cement head and pumping unit, the system comprising a control device which transmits first command signals and second commands signals; a cement head having a first mechanical device therein, the cement head being configured to receive the first command signals and instruct the first mechanical device to perform mechanical operations in response to the first command signals; and a pumping unit having a second mechanical device therein, the pumping unit being configured to receive the second command signals and instruct the second mechanical device to perform mechanical operations in response to the second command signal.

7. A system as defined in paragraph 6, wherein the control device forms part of the pumping unit.

8. A system as defined in paragraphs 6 or 7, wherein the cement head comprises a sensor to sense status parameters of the cement head.

9. A system as defined in any of paragraphs 6-8, wherein the pumping unit comprises a sensor to sense status parameters of the pumping unit.

10. A system as defined in any of paragraphs 6-9, wherein the control device, cement head, and pumping unit comprise wireless communication units.

11. A system as defined in any of paragraphs 6-10, wherein the first and second mechanical devices are at least one of a valve, lever, plunger, or pump.

Moreover, the methodologies described herein may be embodied within a system comprising processing circuitry to implement any of the methods, or a in a non-transitory computer-program product comprising instructions which, when executed by at least one processor, causes the processor to perform any of the methods described herein.

Although various embodiments and methodologies have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A method for centralized control of a cement head and pumping unit, the method comprising:

transmitting a first command signal from a control device;

operating a mechanical device of the cement head in response to the first command signal;

transmitting a second command signal from the control device;

operating a mechanical device of the pumping unit in response to the second command signal;

receiving a status indicator of the cement head at the control device;

transmitting a third command signal from the control device in response to the status indicator; and operating the mechanical device of the cement head in response to the third command signal.

2. The method as defined in claim 1, wherein the control device forms part of the pumping unit.

3. The method as defined in claim 1, further comprising wirelessly transmitting the first, second, and third command signals.

4. A system for centralized control of a cement head and pumping unit, the system comprising:

a control device which transmits a first command signal, a second command signal, and a third command signal;

wherein the cement head has a first mechanical device therein, the cement head being configured to receive the first command signal and instruct the first mechanical device to perform mechanical operations in response to the first command signal;

wherein the control device is configured to receive a status indicator of the cement head, transmit the third command signal in response to the status indicator and operate the mechanical device of the cement head in response to the third command signal; and wherein the pumping unit has a second mechanical device therein, the pumping unit being configured to receive the second command signal and instruct the second mechanical device to perform mechanical operations in response to the second command signal.

5. The system as defined in claim 4, wherein the control device forms part of the pumping unit.

6. The system as defined in claim 4, wherein the cement head comprises a sensor to sense status parameters of the cement head.

7. The system as defined in claim 4, wherein the control device, cement head, and pumping unit comprise wireless communication units.

8. The system as defined in claim 4, wherein the first and second mechanical devices are at least one of a valve, lever, plunger, or pump.

9. A method for centralized control of a cement head and pumping unit, the method comprising:

transmitting a first command signal from a control device;

operating a mechanical device of the cement head in response to the first command signal;

transmitting a second command signal from the control device;

operating a mechanical device of the pumping unit in response to the second command signal;

receiving a status indicator of the pumping unit at the control device;

transmitting a third command signal from the control device in response to the status indicator; and operating the mechanical device of the pumping unit in response to the third command signal.

10. The method as defined in claim 9, wherein the control device forms part of the pumping unit.

11. The method as defined in claim 9, further comprising wirelessly transmitting the first, second, and third command signals.

12. A system for centralized control of a cement head and pumping unit, the system comprising:

a control device which transmits a first command signal, a second commands signals, and a third command signal;

the cement head having a first mechanical device therein, the cement head being configured to receive the first command signal and instruct the first mechanical device to perform mechanical operations in response to the first command signals;

wherein the pumping unit has a second mechanical device therein, the pumping unit being configured to receive the second command signal and instruct the second mechanical device to perform mechanical operations in response to the second command signal; and wherein the control device is configured to receive a status indicator of the pumping unit, transmit the third command signal in response to the status indicator and operate the mechanical device of the pumping unit in response to the third command signal.

13. The system as defined in claim 12, wherein the control device forms part of the pumping unit.

14. The system as defined in claim 12, wherein the pumping unit comprises a sensor to sense status parameters of the pumping unit.

15. The system as defined in claim 12, wherein the control device, cement head, and pumping unit comprise wireless communication units.

16. The system as defined in claim 12, wherein the first and second mechanical devices are at least one of a valve, lever, plunger, or pump.

* * * * *